United States Patent [19]

Argandona

[11] Patent Number: 4,842,443

[45] Date of Patent: Jun. 27, 1989

[54] SPILL CONTAINMENT DEVICE

[76] Inventor: Toby Argandona, 21221 Running Branch Rd., Diamond Bar, Calif. 91765

[21] Appl. No.: 219,668

[22] Filed: Jul. 15, 1988

Related U.S. Application Data

[63] Continuation of Ser. No. 874,858, Jun. 16, 1986, Pat. No. 4,762,440.

[51] Int. Cl.[4] ..... B65B 1/04

[52] U.S. Cl. ..... 405/52; 141/86; 141/98; 141/392; 137/363; 137/312; 137/381; 404/25; 52/20

[58] Field of Search ..... 404/25, 26; 141/86, 141/98, 392; 137/363, 312, 381; 52/20; 405/52

[56] References Cited

U.S. PATENT DOCUMENTS

| | | | |
|---|---|---|---|
| 1,557,885 | 10/1925 | Shanahan | 137/371 |
| 2,264,760 | 12/1941 | Kling | 137/363 |
| 3,633,219 | 1/1972 | Byrd | 137/363 |
| 4,203,686 | 5/1980 | Bowman | 404/25 |
| 4,278,115 | 7/1981 | Briles et al. | 141/86 |
| 4,472,911 | 9/1984 | Jooris et al. | 52/20 |
| 4,527,708 | 7/1985 | Dundas et al. | 141/86 |
| 4,593,714 | 6/1986 | Madden | 404/26 |
| 4,615,362 | 10/1986 | Hartman et al. | 141/86 |
| 4,659,251 | 4/1987 | Petter et al. | 52/20 |
| 4,662,777 | 5/1987 | Newton | 404/25 |
| 4,696,330 | 9/1987 | Raudman et al. | 141/86 |
| 4,706,718 | 11/1987 | Milo | 141/86 |
| 4,763,806 | 8/1988 | Podgers et al. | 141/86 |
| 4,770,317 | 8/1988 | Podgers et al. | 141/86 |
| 4,793,387 | 12/1988 | Le Blanc et al. | 404/25 |

FOREIGN PATENT DOCUMENTS

| | | | |
|---|---|---|---|
| 970333 | 7/1975 | Canada | 52/20 |
| L11414 | 4/1956 | Fed. Rep. of Germany | 404/25 |
| 2343651 | 3/1975 | Fed. Rep. of Germany | 52/20 |
| 3178 | of 1895 | United Kingdom | 404/25 |
| 5102 | of 1902 | United Kingdom | 404/25 |
| 283695 | 1/1928 | United Kingdom | 404/25 |

*Primary Examiner*—Gary L. Smith
*Assistant Examiner*—Eric K. Nicholson
*Attorney, Agent, or Firm*—Boniard I. Brown

[57] ABSTRACT

A spill containment device for the fill tube of a liquid storage tank, particularly an underground, liquid storage tank. The containment device has a spill container with a bottom opening for receiving the tank fill tube in liquid sealing relation to the container wall and a top opening through which the fill tube is accessible for filling the tank, whereby the container contains any liquid spill during filling of the tank. The container top opening is closed by a removable cover which cooperates with a water drain arrangement to vent liquid vapor from the container while preventing rain and other ground surface water from entering the container. A drain valve operable from a position adjacent the container top opening is provided for draining liquid spill from the container to the tank. One embodiment is designed to receive multiple tank fill tubes and has a surrounding casing with a relatively massive top end closure having openings closed by separate relatively small covers which are individually removable to access the different tank fill tubes.

1 Claim, 3 Drawing Sheets

SPILL CONTAINMENT DEVICE

This is a continuation of co-pending application Ser. No. 06/874,858 filed on June 16, 1986 U.S. Pat. No. 4,762,440.

BACKGROUND OF THE INVENTION

1. Field of the Invention

This invention relates generally to environmental protection aids and more particularly to a spill containment device for the fill tubes of storage tanks, particularly underground storage tanks, for environmentally hazardous liquids such as gasoline and other petroleum products.

2. Discussion of the Prior Art

As will appear from the ensuing description, the present spill containment invention may be utilized on virtually any liquid storage tank having a fill tube through which thetank is filled. The invention may also be used on both above ground and below ground storage tanks. However, the invention is particularly concerned with underground storage tanks for petroleum products, such as gasoline, diesel fuel and the like.

Underground storage tanks used in the storage of toxic or flammable liquids, such as those used for storage of petroleum products at service stations and the like, normally include a casing or fill pipe that runs from the subsurface tank up to the ground surface. A manhole surrounds the upper end of the casing in order to access the casing and provide clearance for a valve used to connect delivery truck fill hoses to the casing. Although most liquid product delivery trucks or equipped with a shut-off valve that stops liquid flow to the fill hose when a storage tank is full, spillage of product is common when filling such tanks. Spills normally occur due to leakage at the fill pipe-hose coupling or by the discharge of the standing liquid within the truck hose. Even though the truck's shut-off valve halts delivery to the base, the truck hose remains filled with liquid product. When the hose is disconnected from the casing, this remaining liquid runs out onto the ground.

The contamination produced by such liquid storage tank spills results in a substantial health hazard. When toxic or flammable liquids, such as gasoline, diesel fuel or the like are dumped onto the ground, these products may enter the local ground water or otherwise enter into the ecosystem. Even if the spillage is not absorbed into the ground but is drained off into a sewage system, a toxic or explosive atmosphere can be produced within the local sewer system.

SUMMARY OF THE INVENTION

According to its more limited aspects, this invention provides a spill containment device for containing such liquid spills occuring during filling of underground gasoline and diesel fuel storage tanks. As noted above, however, the invention is not limited to this application and may be used on both above ground and below ground storage tanks for any liquid.

Simply stated, the spill containment device of the invention comprises a spill container having a bottom opening for receiving a storage tank fill tube, a top access opening through which the fill tube is accessible for filling the tank, and means for sealing the tube to the spill container wall, whereby the container contains any liquid spill during filling of the tank. According to one feature of the invention, the top access opening of the spill container is closed by a removable cover in a manner which vents vapor from the container, to prevent excess vapor pressure buildup in the container, while preventing leakage of rain and other ground surface water into the container.

According to another feature of the invention, the spill containment device has means for draining liquid spill from the spill container back to the liquid storage tank, either directly or through the tank fill tube. Liquid drainage from the container to the tank is controlled by a valve operable, from a position close to the container top opening to avoid the necessity of immersing one's hands in liquid within the container.

One disclosed embodiment of the invention has a spill container to be recessed into the ground over an underground storage tank with the container top substantially flush with the ground surface. Another disclosed embodiment has a spill container mounted within a surrounding casing to be recessed into the ground over an underground storage tank. This casing may be existing underground tank fill casing, such as commonly used at service stations, or may be fabricated with the rest of the spill containment device. The casing has a top end closure like a manhole cover over the spill container and containing an access opening to the tank fill tube in the container. One particular embodiment illustrated is designed to receive two tank fill tubes and has a pair of acess openings, one for each fill tube, in the casing top closure or manhole cover. Each access opening is closed by a removable cover which is substantially smaller and lighter, hence much more easily removable, than the heavy manhole cover of the existing tank fill tube casings installed at many service stations.

DESCRIPTION OF THE PREFERRED EMBODIMENT

Figure 1:
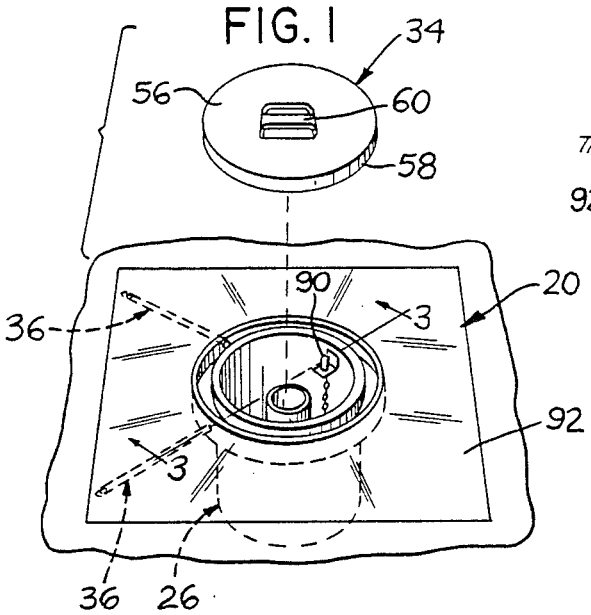
FIG. 1 is a perspective view of a spill containment device according to the invention installed below ground.
Figure 2:
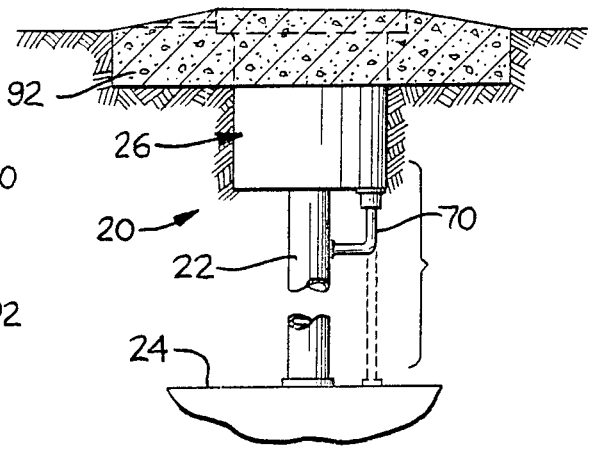
FIG. 2 is a side elevation of the spill containment device in FIG. 1 with the surrounding ground shown in section.
Figure 3:
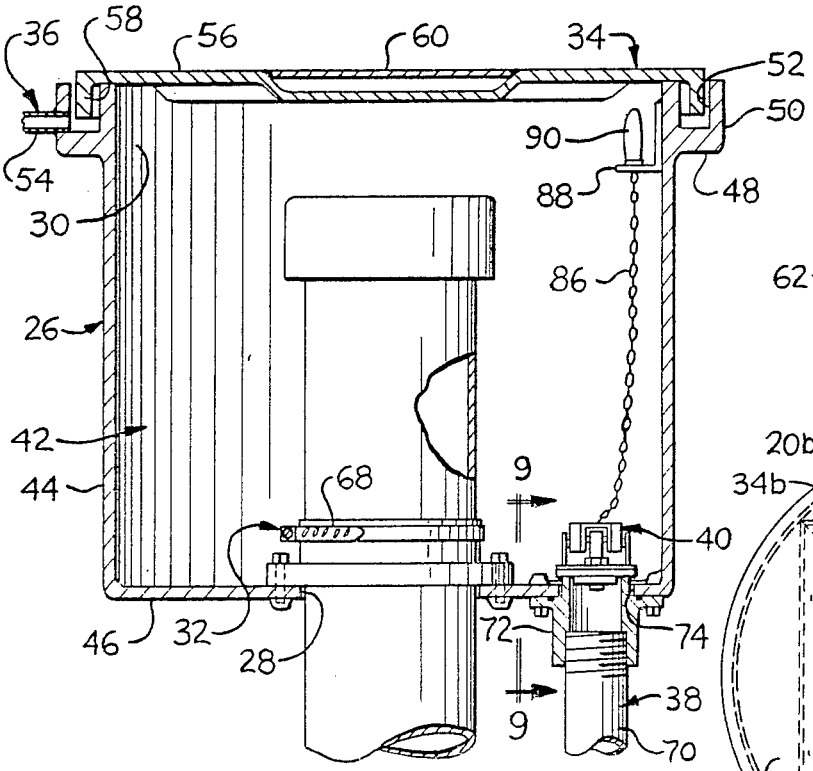
FIG. 3 is an enlarged section taken on line 3—3 in FIG. 1.
Figure 4:
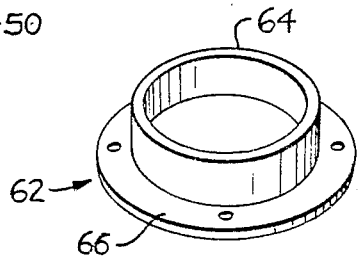
FIG. 4 is a perspective view of a sealing boot embodied in the spill containment device.
Figure 10:
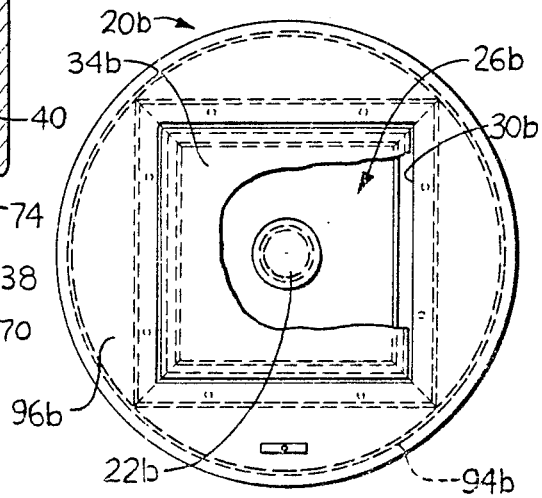
FIG. 10 is a top plan view of a further modified spill containment device of the invention with a top cover broken away to expose the underlying spill container.

Referring first to FIGS. 1-4 and 10, there is illustrated a spill containment device 20 according to the invention for the fill tube 22 of an underground storage tank 24 for environmentally hazardous liquids, such as gasoline, diesel fuel, and other petroleum products. Stated generally, the spill containment device 20 includes a spill container 26 having a bottom opening 28 for receiving the tank fill tube 22, a top access opening 30 through which the fill tube is accessible for filling the tank 24 through the tube, and means 32 for sealing the tube to the wall of the spill container 26.

The spill container 26 catches and contains any liquid spill during filling of the tank 24. As noted earlier, such spill may be due to a leak in the coupling between the tank fill pipe 22 and the hose (not shown) though which the tank is filled from a tanker truck or the like, or due to drainage of liquid from the hose when the latter is connected to and/or removed from the fill pipe. Spill may also occur due to overfilling of the tank. The spill is thus prevented from falling on the ground and thereby creating an environmental, health, and/or safety hazard.

According to one important feature of the invention, the top access opening 30 of the spill container 26 is closed by a removable cover 34 which cooperates with water drainage means 36 to vent liquid vapor from the container while preventing entrance of rain and ground surface water from entering the container. Venting vapor from the container prevents a vapor pressure buildup in the container which at the least could cause discomfort to the person removing the container cover 34 and could create and explosive condition.

Another feature of the invention resides in the fill tube seal 32 with both clamps and seals the spill container 26 to the tank fill tube 22. The seal is resilient to accommodate some degree of relative movement between the spill container and fill tube in the event of an earthquake. A further important feature of the invention resides in means 38 for draining liquid spill from the spill container 26 to the storage tank 24 either directly or through the tank fill tube 22. This liquid draining means includes a valve 40 for controlling liquid flow from the container to the tank. The valve is operable from a position close to the spill container access opening 30 so that the valve may be opened and closed without immersing one's hands in any liquid within the container.

Referring now in more detail to the drawings, the spill container 26 comprises a cylindrical cup-like body 42 having a cylindrical side wall 44 and a bottom wall 46. The container bottom opening 28 is located at the center of the bottom wall 46. Encircling the container side wall 44 a short distance below the upper end is an outwardly directed shoulder 48 terminating in an upwardly directed annular wall 50. The shoulder 48, wall 50, and the portion of the spill container wall 44 above the shoulder form an upwardly opening annular gutter as channel 52 encircling the upper end of the container. The outer channel wall 50 is slightly lower than the upper end of the container wall 44. Extending from the channel 52 is a drain conduit 54.

The spill container cover 34 has a top wall 56 which spans the container top opening 30. About the edge of the wall 56 is a depending annular flange 58 which projects downwardly into the channel 52. the cover has a handle 60 for lifting the cover from the spill container 26.

The cover 34 closes the top opening 30 of the spill container 26 to prevent the entrance of rain and ground surface water from entering the container. Thus, water flowing over the cover enters the container channel 52 and then drains through the drain conduit 54. Since the outer channel wall 50 is lower than the upper end of the spill container wall 44, water will overflow the channel wall 50 if the channel 52 fills and thus not enter the container. Moreover, the cover seals the spill container only by seating on the upper edge of the container wall 44. As a consequence, the cover permits vapor to vent from the spill container, thereby preventing a dangerous buildup of vapor pressure in the container. Thus the cover 34 and water drainage means cooperate to prevent entrance of rain and surface water into the spill container while permitting vapor to vent from the container.

The seal 32 for sealing the spill container 26 to the tank fill pipe 22 comprises a sealing boot 62 (FIG. 4) mounted on the container bottom wall 46. This sealing boot has a resilient sealing sleeve 64 and a mounting flange 66 about one end of the sleeve. The sealing boot seats on the upper side of the spill container bottom wall 46 about and in coaxial alignment with the wall opening 28. The boot flange 66 is bolted to the container bottom wall 46 in liquid sealing relation to the wall. The sealing boot sleeve 64 is internally sized to receive the tank fill tube 22 with a slip or slightly snug fit. The sleeve is surrounded by a hose clamp 68 which is adjustable to constrict the sleeve into liquid sealing relation to the fill tube.

As noted earlier, the spill containment device 20 includes means 38 including a valve 40 for draining liquid from the spill container 26 into the liquid storage tank 24. This liquid drainage means includes a drain conduit 70 which extends from the container to the tank fill pipe 22 below the container. The upper end of the drain conduit is threaded in a coupling 72 which projects upwardly through an off-center opening 74 in and is bolted and sealed to the bottom wall 46 of the spill container 26. The drain conduit opens through the coupling into the bottom of the container. The lower end of the drain conduit has a right angle bend and is coupled to the tank fill tube 22 whereby liquid can drain from the spill container 26 into the storage tank 24 through the fill tube.

Figure 9:
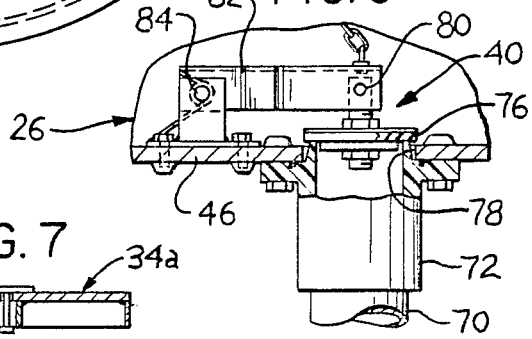
FIG. 9 is an enlarged section taken on line 9—9 in FIG. 3 with portions broken away for clarity.
Figure 6:
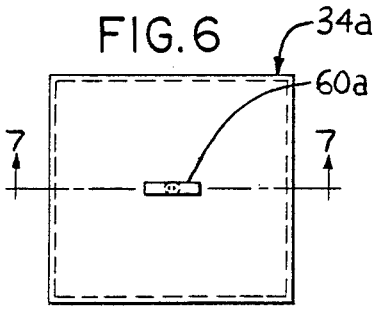
FIG. 6 is a top plan view of a removable cover for one top spill container access opening of the spill containment device of FIG. 5.
Figure 7:
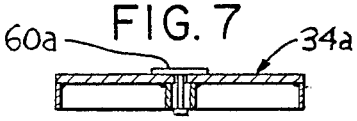
FIG. 7 is a section taken on line 7—7 in FIG. 6.
Figure 8:
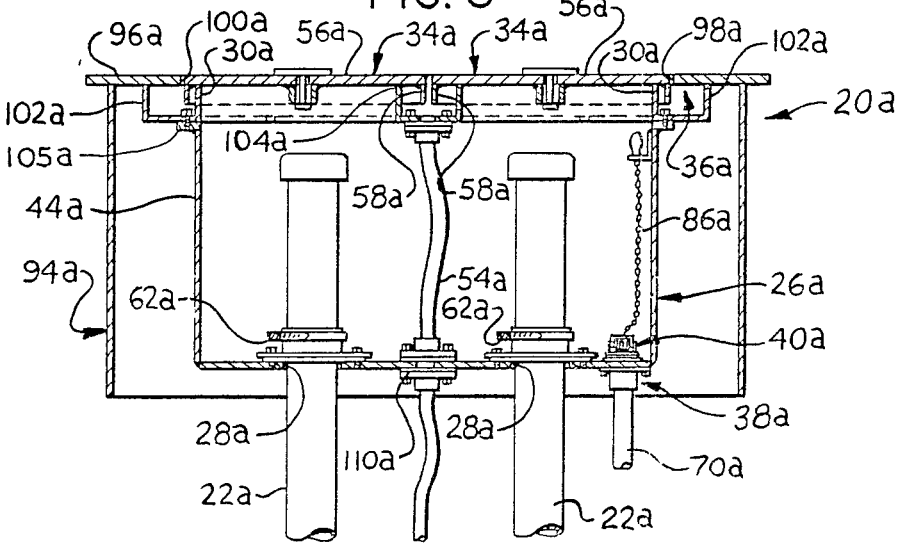
FIG. 8 is a section taken on line 8—8 in FIG. 5.

Drain valve 40 controls liquid drainage from the spill container 26 through the drain conduit 70. Valve 40 comprises a valve member 76 moveable between open and closed positions relative to an annular valve seat 78 about the drain passage through the drain conduit 70 and coupling 72. Valve seat 78 is formed by the upper end of the coupling. Valve member 76 is a disc pivotally mounted by a pin 80 on one end of an arm 82. The opposite end of the arm is pivotally mounted on a pivot bracket 84 fixed to the bottom wall 46 of the spill container 26. The valve arm 82 supports the valve member 76 for pivotal movement between its closed position of FIG. 9, wherein the valve member engages the valve seat 78 and an open position wherein the valve member is spaced upwardly from the valve seat.

Valve 40 has an operator 86 which is accessible for opening and closing the valve from a position close to the spill container access opening 30. Accordingly, the valve may be opened and closed without immersing one's hands in liquid in the container. The valve operator shown is a chain secured at its lower end to the valve arm 82. The upper end of the chain passes through an opening in a bracket 88 fixed to the upper end of the spill container side wall and terminates in a handle 90 by which the chain may be pulled to open the valve 40. The valve closes by gravity when released.. A spring may aid valve closure. The handle 90 prevents the chain 86 from disengaging the chain bracket 88.

As mentioned earlier and shown in the drawings, the particular spill containment device 20 illustrated is installed on an underground storage tank 24. In this installation, the spill container 26 is recessed into the ground over the tank with the top of the container substantially flush with or slightly above the surrounding ground surface. The top of the container is embedded in concrete 92 to firmly anchor the spill containment device in position. The water drainage tubes 54 extend outwardly through the concrete, as shown in FIG. 1. The resilient sealing sleeve 64 provides sufficient resiliency between the spill containment device 20 and the tank fill tube 22 to maintain an effective seal and prevent breakage of the fill tube during earth tremors.

Turning now to FIGS. 5–8, there is illustrated a modified spill containment device **20*a* according to the invention which is smaller in many respects to the spill containment device 20 just described. For this reason, corresponding parts of the two devices are denoted by the same reference numerals with the suffix a applied to the reference numerals in FIGS. 5–8. Moreover, because of this similarity, the description of the modified spill containment device will be somewhat abbreviated with most of the detailed description being limited to those features which differ from the spill containment device of FIGS. 1–4. The same applies to the other described embodiments of FIGS. 10–13** except that the suffixes b and c are used in the latter figures.

With this introduction in mind, the spill containment device **20*a* comprises a spill container 26*a* with two bottom fill pipe openings 28*a*. The container is open at its top. The bottom openings 28*a* are adapted to receive two underground storage tank fill pipes 22*a*. The open top of the container is closed by two removable covers 34*a* centered over the fill pipe openings 28*a*, respectively. The covers are individually removable to provide access to the fill pipes 22*a*, respectively, for filling their tanks. The bottom wall of the spill container is sealed to the fill pipes, about their bottom container openings 28*a*, by resilient sealing boots 62*a* like that in FIGS. 1–4**.

The modified spill containment device **20*a* has drain means 38*a* for draining liquid from the spill container 26*a* back to the liquid storage tank. This drain means comprises a drain conduit 70*a* extending from the bottom of the spill container to the underground liquid storage tank and a valve 40*a* like that in FIG. 10 for controlling liquid flow from the container through the drain conduit. The valve operator 86*a*** is accessible near the top of the spill container so that the valve may be opened and closed without immersion of the operator's hands in any liquid in the tank.

As mentioned, the major difference between the spill containment devices of FIGS. 1–4 and 5–8 is that the latter device accommodates a plurality of storage tank fill tubes, specifically two fill tubes as shown, whereas the device of FIGS. 1–4 accommodates only a single fill tube. In the past, such dual fill tube installations have had a casing recessed into the ground into which the fill tubes projected. This casing had a top "manhole" through which the fill tubes were accessible for filling their tanks. The opening was closed by a relatively large and heavy "manhole" cover which was difficult to remove and replace.

Figure 5:
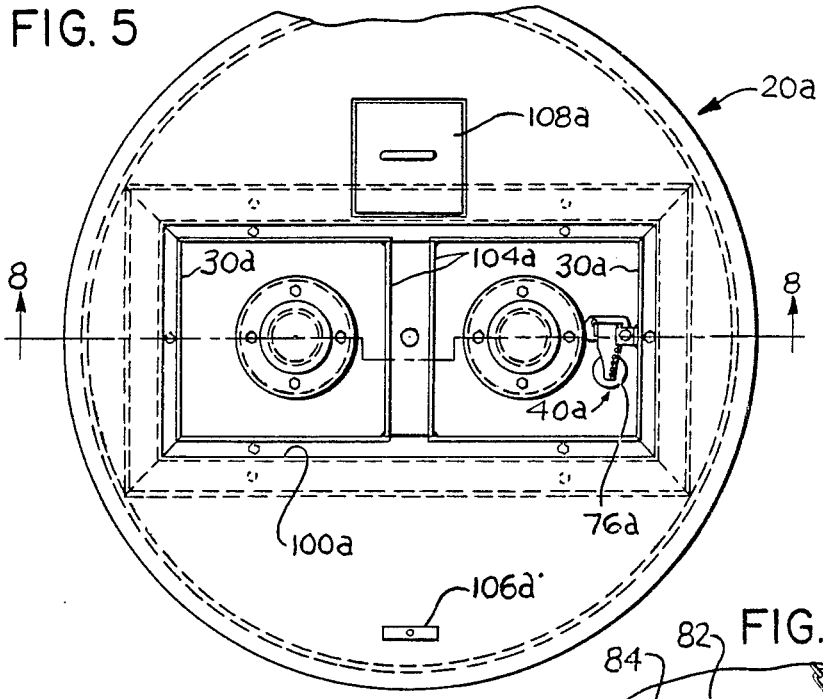
FIG. 5 is a top plan view of a modified spill containment device according to the invention.

The inventive embodiment of FIGS 5∝8 utilizes the existing manhole casing and cover but eliminates its above disadvantages. In FIGS. 5–8, the manhole casing is shown at **94*a* and its cover is shown at 96*a***. The bottom of the casing is open.

The spill container **26*a* is firmly mounted within the casing 94*a*. This mounting may be accomplished in various ways. In the particular embodiment illustrated, the casing cover 96*a* has a rectangular opening 100*a* overlying and slightly larger than the open top of the spill container 26*a*. Welded to the underside of the casing cover along the sides and ends of this rectangular opening are upwardly opening channel 102*a*. The inner sides of these channels project slightly beyond their respective edges of the opening 100*a* so that the channels open upwardly through the opening. An upwardly opening channel 104*a* extends across the center of the opening 100*a* and is welded to the two side channels 102*a*. About the upper end of the spill container 26*a* is an outwardly projecting flange 105*a* which seats against the bottom web walls of the edge channels 102*a*** in liquid sealing relation to these walls and is bolted to the channels.

The channels **102*a*, 104*a* define two access openings 30*a* to the spill container 26*a*. These openings are closed by the removable covers 34*a* and are centered over the two fill pipe openings 28*a* to provide access to the fill pipes 22*a* when the covers are removed. Each cover has a handle 60*a*. The manhole cover 96*a* may also be removable, if desired, and to this end has a handle 106*a*. In the particular embodiment illustrated, however, the manhole cover 96*a* is welded to the casing 94*a*. The manhole cover also has an off-center pening closed by a cover 108*a*** which is removable to permit reading of the storage tank guages (not shown) mounted within the casing.

The spill container covers **34*a* have top walls 56*a* and depending edge flanges 58*a*. The cover walls 56*a* span the container access opening 30*a* and rest on the inner side walls of the edge channels 102*a* and on the side walls of the center channel 104*a*. The cover flanges 58*a*** project downwardly into the channels.

The channels **102*a*, 104*a* form part of a water drain means 36*a* which cooperates with the covers 34*a* to permit liquid vapor to vent from the spill container 26*a* while preventing rain and other surface water from entering the container. To this end, the interior spaces of all the channels 102*a*, 104*a* communicate with one another. Opening to and extending downwardly through the spill container 26*a* from the center channel 104*a* is a drain conduit 54*a*. This drain conduit extends through the bottom wall 46*a* of the spill container 26*a* into the ground and is sealed to the latter wall by a seal 110*a***.

Rain and other ground surface water flowing over the manhole cover **96*a* and spill container access covers 34*a* enters the channels 102*a*, 104*a* and then drains to the ground through the drain conduit 54*a*. Thus, the channels form water drain gutters or channels about the spill container access openings 30*a* which catch water flowing over the edges of the covers 34*a* and the edges of the manhole cover opening 100*a*** and drain the water into the ground.

The modified spill containment device **20*b* is identical to that of FIGS. 5–9 with the following exceptions. The modified device is designed for use with a single underground tank fill tube 22*b*. To this end, the manhole cover 96*b* of the device has a single access opening 30*b*** to the underlying spill container 26b closed by a single removable cover 34b. The modified device has opening in the manhole cover for reading an underlying liquid storage tank gauge. Otherwise, the modified spill containment device is essentially the same as that of FIGS. 5-9, except as to the relative dimensions of the spill container 26b and its surrounding casing 94b.

The spill containment devices 20a and 20b of FIGS. 5-10 have a common advantage over existing underground tank fill installations having recessed fill tube casings. This advantage resides in the fact that in the present spill containment devices, it is unnecessary to remove the heavy casing manhole covers 96a, 96b to gain access to the tank fill tubes. Only the relatively small lightweight covers 34a, 34b need be removed.

Figure 11:
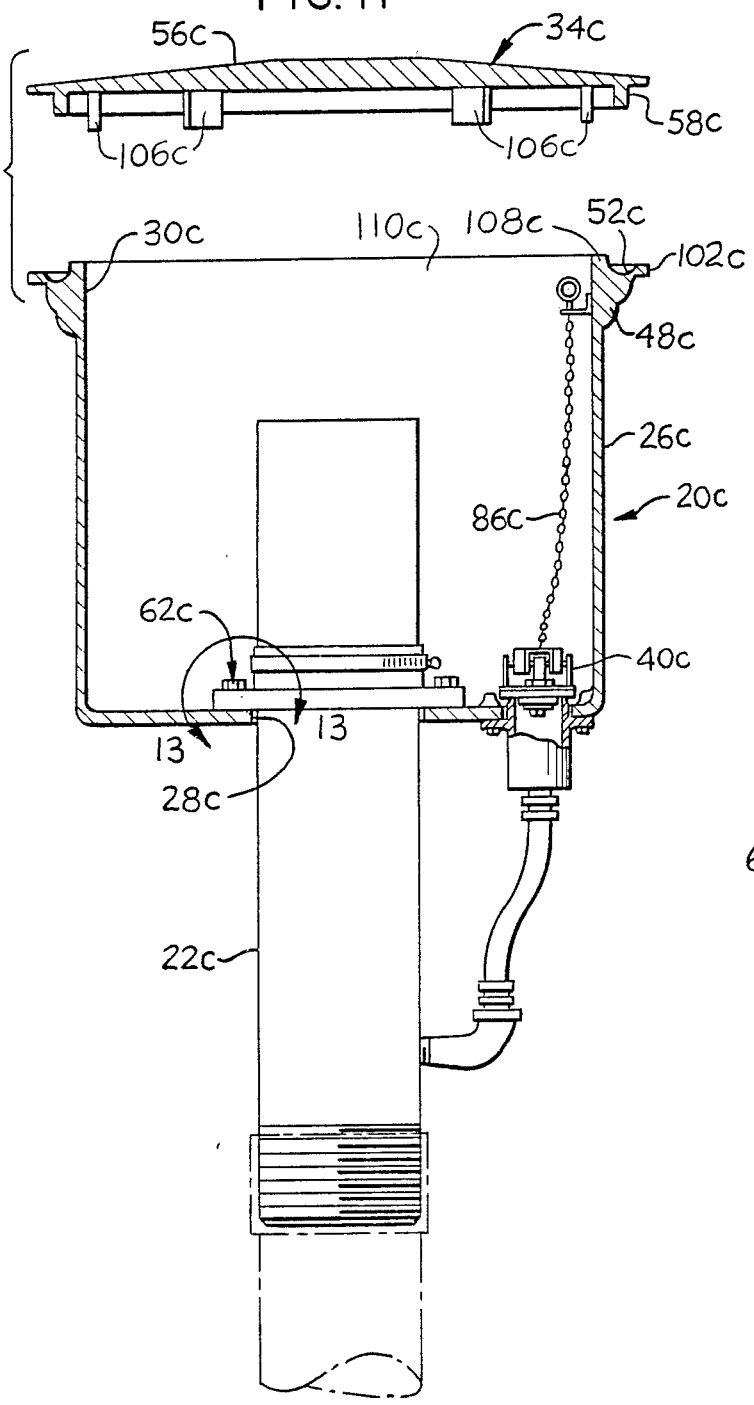
FIG. 11 is a vertical section through a further modified spill containment device of the invention.
Figure 12:
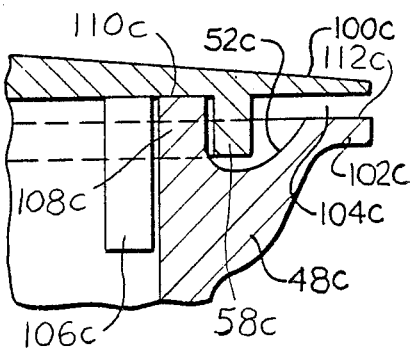
FIG. 12 is an enlarged detail of the device in FIG. 11.
Figure 13:
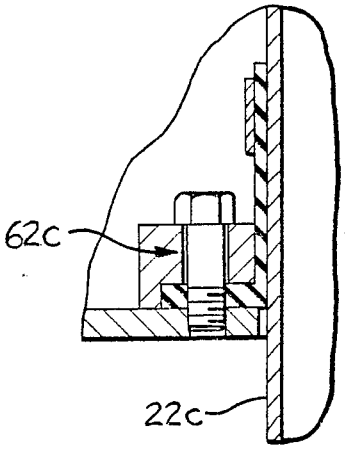
FIG. 13 is an enlargement of the area 13—13 in FIG. 11.

Turning now to FIGS. 11-13, there is illustrated a modified spill containment device 20c having a spill container 26c with a single bottom opening 28c for receiving a tank fill tube 22c. The fill tube is sealed to the tank by a sealing boot 62c like that illustrated in FIG. 4. Extending from the bottom of the spill container 26c to the fill tube 22c is a liquid drain conduit 70c. A drain valve 40c like that in FIG. 9 and having an operator 86c operable from the top of the spill container controls liquid flow from the container through the drain conduit.

The spill container 26c has a single top opening 30c through which the fill tube 22c is accessible for filling its liquid storage tank. This top opening is closed by a removable cover 34c. Cover 34c has a top wall 56c and a circumferential flange 58c depending from the underside of the top wall. The top wall 56c projects radially a distance beyond the flange 58c to form outwardly of the flange a lip 100c extending circumferentially around the cover. The cover flange 58c is sized to surround the upper end of spill container 26c when the cover is in place on the container.

Surrounding the upper end of the spill container 26c is a relatively thick circumferential flange 48c defining an upwardly opening channel 52c about the container and an annular lip 102c outwardly of the channel. Depending from the underside of the cover 34c along the inside of the spill container 26c are legs 106c for resisting tipping of the cover in the event a force is applied to the cover lip 100c, such as might occur if an automobile drives across the cover edge.

The upper end of the container 26c forms an annular rim 108c about the top access opening 30c to the container interior. This rim has an upper edge 110c about the top opening disposed in a transverse plane of the container.

When the cover 34c is positioned on the container 26c to close its top access opening 30c, the top wall 56c of the cover rests on the upper edge 110c of the container rim 108c, as shown in FIG. 12, about the full circumference of the container to form a relatively watertight seal between the cover and the container. The cover flange 58c surrounds the container rim 108c and depends downwardly into the channel 52c in spaced relation to the bottom wall of the container, as also shown in FIG. 12, to permit firm seating of the cover top wall 56c on the upper rim edge 110c.

The upper surface 112c of the container lip 102c is disposed in a transverse plane of the container 26c which is substantially parallel to and disposed below the plane of the upper edge 110c of the container rim 108c. The open upper side of the container channel 52c is disposed in the plane of the container lip surface 112c which extends from the channel to the outer edge of the lip 102c.

The spill containment device 20c is used in essentially the same way as the earlier described spill containment devices, by installing the spill container 26c in the ground with the container coupled to the underground tank fill tube 22c to catch any spillage during filling of the tank, and with the upper open side of the container channel 52c, and hence also the container lip surface 112c, substantially at ground level—that is substantially flush with the surrounding ground surface.

In this modified spill containment device, water flowing along the ground surface or directed by a hose between the cover and container lips 100c, 102c into the channel 52c strikes the cover flange 58c and tends to swirl or eddy in the channel and thereby lose sufficient momentum to pass upwardly between the cover flange 58c and the spill container rim 108c and then between the upper rim edge 110c and the cover top wall 56c into the container.

The inventor claims:

1. A spill containment device for an underground storage tank having a fill tube located below ground level, said containment device comprising:

a spill container having a top access opening to the container interior, and annular rim circumferentially surrounding said top opening an annular lip radially outward of and circumferentially surrounding said rim, and an upwardly opening annular channel between said rim and lip and circumferentially surrounding said rim, said rim having an upper edge circumferentially surrounding said top opening and disposed in a first transverse plane of said container, said lip having an upper surface circumferentially surrounding said rim and disposed in a second transverse plane of said container substantially parallel to and located below the level of said first plane of said upper rim edge, and said channel extending below and having an open upper side disposed in said second plane of said upper lip surface, a cover for said container including a top wall having a circumferential edge and an annular flange depending from the underside of said top wall radially inward of said cover circumferential edge, whereby said cover has a lip radially outward of and circumferentially surrounding said flange, and said cover is positionable on the top of said container with said top wall seating on said upper edge of the container rim about the full circumference of the rim to form a relatively water-tight seal between the cover and the container about the full circumference of the container rim, and with said flange surrounding the container rim and extending downwardly into said container channel in spaced relation to the bottom of the channel to permit seating of said top wall on said upper rim edge, and with said cover lip overlying and disposed in close proximity of said container lip, and means for coupling said container to the storage tank fill tube, and wherein said spill container is adapted to be placed in the ground with said container lip upper surface disposed substantially at ground level and with the container coupled to the tank fill tube to catch any spillage during filling of the tank through the spill tube.

* * * * *